US012239182B2

(12) United States Patent
Agustsson

(10) Patent No.: US 12,239,182 B2
(45) Date of Patent: Mar. 4, 2025

(54) SIZE ADAPTIVE PROTECTIVE HEADGEAR

(71) Applicant: GLOBUS (SHETLAND) LTD., Manchester (GB)

(72) Inventor: Haraldur Agustsson, Manchester (GB)

(73) Assignee: GLOBUS (SHETLAND) LTD., Manchester (GB)

( * ) Notice: Subject to any disclaimer, the term of this patent is extended or adjusted under 35 U.S.C. 154(b) by 87 days.

(21) Appl. No.: 17/774,305

(22) PCT Filed: Nov. 4, 2020

(86) PCT No.: PCT/EP2020/080959

§ 371 (c)(1),
(2) Date: May 4, 2022

(87) PCT Pub. No.: WO2021/089619

PCT Pub. Date: May 14, 2021

(65) Prior Publication Data

US 2022/0386735 A1 Dec. 8, 2022

(30) Foreign Application Priority Data

Nov. 4, 2019 (GB) ..... 1916003

(51) Int. Cl.

| | |
|---|---|
| ***A42B 3/32*** | (2006.01) |
| ***A42B 3/12*** | (2006.01) |
| ***A42B 3/28*** | (2006.01) |

(52) U.S. Cl.

CPC ..... *A42B 3/324* (2013.01); *A42B 3/125* (2013.01); *A42B 3/283* (2013.01)

(58) Field of Classification Search

CPC ..... A42B 3/324; A42B 3/32; A42B 3/125; A42B 3/283; A42B 3/10; A42B 3/0493

See application file for complete search history.

(56) References Cited

U.S. PATENT DOCUMENTS 5,915,537 A * 6/1999 Dallas ..... A42B 3/08 2/425

6,154,889 A * 12/2000 Moore, III ..... A42B 3/324 2/418

(Continued)

FOREIGN PATENT DOCUMENTS

DE 10 2006 058 782 6/2008

OTHER PUBLICATIONS

International Search Report for PCT/EP2020/080959 dated Feb. 25, 2021, 4 pages.

(Continued)

*Primary Examiner* — Patrick J. Lynch
*Assistant Examiner* — Brianna T. Duckworth
(74) *Attorney, Agent, or Firm* — NIXON & VANDERHYE

(57) ABSTRACT

Disclosed is a size adaptive protective headgear including a protective shell including a first and a second front cut extending respectively from a first and second side edge of the protective shell, the first and second front cut enabling expansion and contraction of a front section of the protective shell, and a first and a second rear cut extending respectively from a first and second side edge of the protective shell, the first and second rear cut enabling expansion and contraction of a rear section of the protective shell.

11 Claims, 12 Drawing Sheets

(56) References Cited

U.S. PATENT DOCUMENTS

| | | | | |
|---|---|---|---|---|
| 7,475,434 | B2 * | 1/2009 | Ambuske | A42B 3/28 2/425 |
| 2012/0011639 | A1 * | 1/2012 | Beauchamp | A42B 3/324 2/414 |
| 2013/0340146 | A1 | 12/2013 | Dekker et al. | |
| 2016/0316846 | A1 * | 11/2016 | Salvetti | A42B 3/04 |
| 2018/0192723 | A1 | 7/2018 | Williams et al. | |
| 2019/0090573 | A1 | 3/2019 | Votel et al. | |

OTHER PUBLICATIONS

Written Opinion of the ISA for PCT/EP2020/080959 dated Feb. 25, 2021, 5 pages.

* cited by examiner

SIZE ADAPTIVE PROTECTIVE HEADGEAR

This application is the U.S. national phase of International Application No. PCT/EP2020/080959 filed Nov. 4, 2020 which designated the U.S. and claims priority to GB Patent Application No. 1916003.5 filed Nov. 4, 2019, the entire contents of each of which are hereby incorporated by reference.

FIELD OF THE INVENTION

Generally the present invention relates to protective headgear. In particular, the present invention pertains to size adaptive protective headgear.

BACKGROUND

Today, there exists a wide range of protective headgear. There are also some solutions where the size of the headgear is adjustable. This may include straps or other size-adjustable means that are adjusted to fit the particular user.

Still, there exists a need for a one size fits all type of solution where the same headgear adjusts and fits to most head shapes and head sizes without adjusting any separate adjustment means by the user. There exists a need for a solution where the user may simply place the headgear on his/her head and the headgear adjusts to the shape and size of the user's head.

One size fits all type of solutions are typical in hats and baseball caps, for example. Usually, in these garments the material is flexible such as a flexible strap around the baseball cap circumventing the head of the user, or winter hats, which are manufactured of wool or other fabric that expands when pulled over the head.

Solely, using a flexible material to provide a size adaptive protective headgear may turn out to be difficult, because a material that has much flexibility as such may not have enough protective qualities for the intended use such as to protect against bumps and lacerations.

SUMMARY OF THE INVENTION

The objective is to at least alleviate the problems described hereinabove not satisfactorily solved by the known arrangements, and to provide a feasible size adaptive protective headgear. One objective is to provide a protective headgear that adapts to fit different head shapes in a forward to rear expansion and contraction motion. Another objective is to provide a protective headgear that protects against bumps and lacerations. A further objective is to provide a headgear that is approved to EN812, industrial bump caps.

The aforesaid objectives are achieved by the embodiments of a size adaptive protective headgear in accordance with the present invention.

The aforesaid objective(s) are achieved according to the present invention as claimed in claim 1.

Accordingly, in one aspect of the present invention a size adaptive protective headgear comprises

- a protective shell comprising,
  - a first and a second front cut extending respectively from a first and second side edge of the protective shell, the first and second front cut enabling expansion and contraction of a front section of the protective shell, and
  - a first and a second rear cut extending respectively from a first and second side edge of the protective shell, the first and second rear cut enabling expansion and contraction of a rear section of the protective shell.

In one embodiment the first and second front cut extends in a first direction towards the opposite side of the protective shell, and in a second direction towards the rear end of the shell.

In one embodiment the first and second front cut extends in a third direction towards the rear end of the protective shell, the third direction diverging from the second direction towards the same first and second side edge where the first and second front cut extends from.

In one embodiment the first and second rear cut extends in a first direction towards the opposite side of the protective shell, and in a second direction towards the front end of the protective shell.

In one embodiment the first and second rear cut extends in a third direction towards the front end of the protective shell, the third direction diverging from the second direction towards the same first and second side edge where the first and second rear cut extends from.

In one embodiment the size adaptive protective headgear comprises an insert.

In one embodiment the size adaptive protective headgear comprises attachment means for attaching the insert to the protective shell.

In one embodiment the attachment means comprises at least two front attachment holes and at least one rear attachment hole in the protective shell, and respectively at least two front attachment protrusions and at least one rear attachment protrusion in the insert, the at least two front attachment protrusions and at least one rear attachment protrusion being arranged to attach to the at least two front attachment holes and the at least one rear attachment hole.

In one embodiment the protective shell is made of high-density polyethylene (HDPE) plastic. In one embodiment the protective shell is made of polycarbonate, polyamide (e.g. Nylon 6), polyoxymethylene (POM) or acrylonitrile butadiene styrene (ABS).

In one embodiment the insert is made of polypropylene foam. In one embodiment the insert is made of polystyrene foam or polyurethane foam.

In one embodiment the protective shell comprises at least one inlet in a front section of the protective shell and at least one outlet in a rear half of the protective shell for enabling air flow.

In one embodiment the insert comprises at least one channel arranged to guide air from the at least one inlet of the protective shell to the at least one outlet of the protective shell.

In one embodiment the protective shell comprises at least four inlets and at least eight outlets, the insert comprising at least four channels, wherein two channels connect from two inlets to one outlet.

The utility of the present invention follows from a plurality of factors depending on each particular embodiment. In some embodiments of the present invention the shell may be a one size fits all design that may adapt to fit different head shapes in a forward to rear expansion and contraction motion. Some embodiments of the present invention may protect against bumps and lacerations. Some embodiments of the present invention may be approved to EN812, industrial bump caps.

The expression "a number of" refers herein to any positive integer starting from one (1), e.g. to one, two, or three.

The expression "a plurality of" refers herein to any positive integer starting from two (2), e.g. to two, three, or four.

Different embodiments of the present invention are disclosed in the dependent claims.

BRIEF DESCRIPTION OF THE RELATED DRAWINGS

Next the invention is described in more detail with reference to the appended drawings in which FIG. 1 illustrates a first embodiment of a protective headgear in accordance with the present invention.

DETAILED DESCRIPTION OF THE EMBODIMENTS

Figure 1:
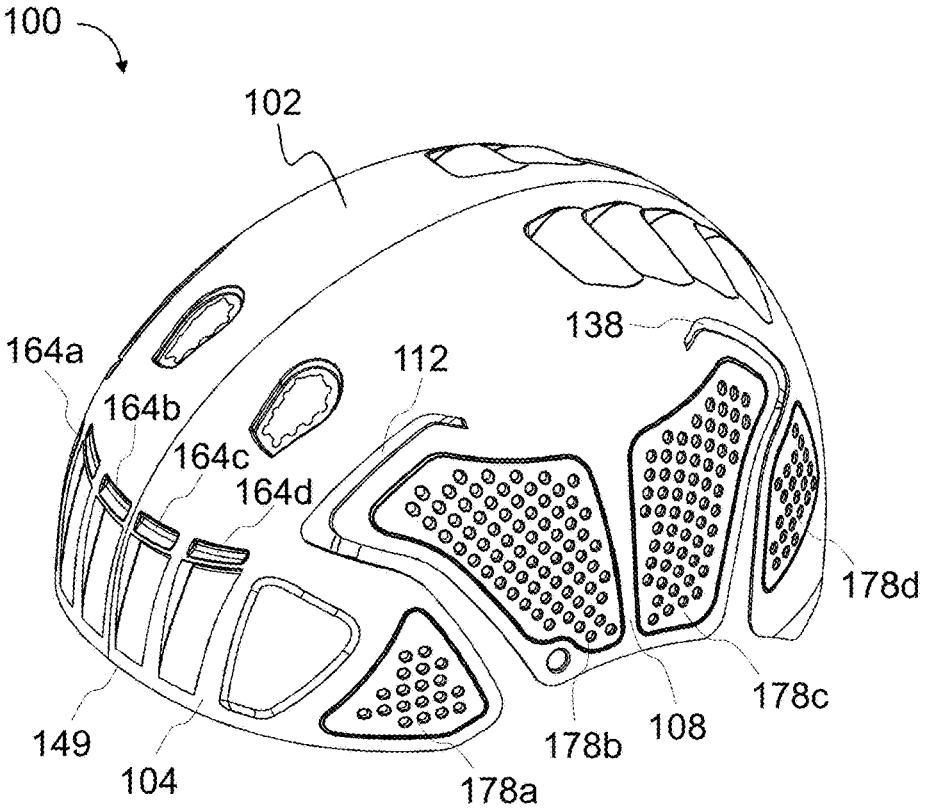
Figure 2:
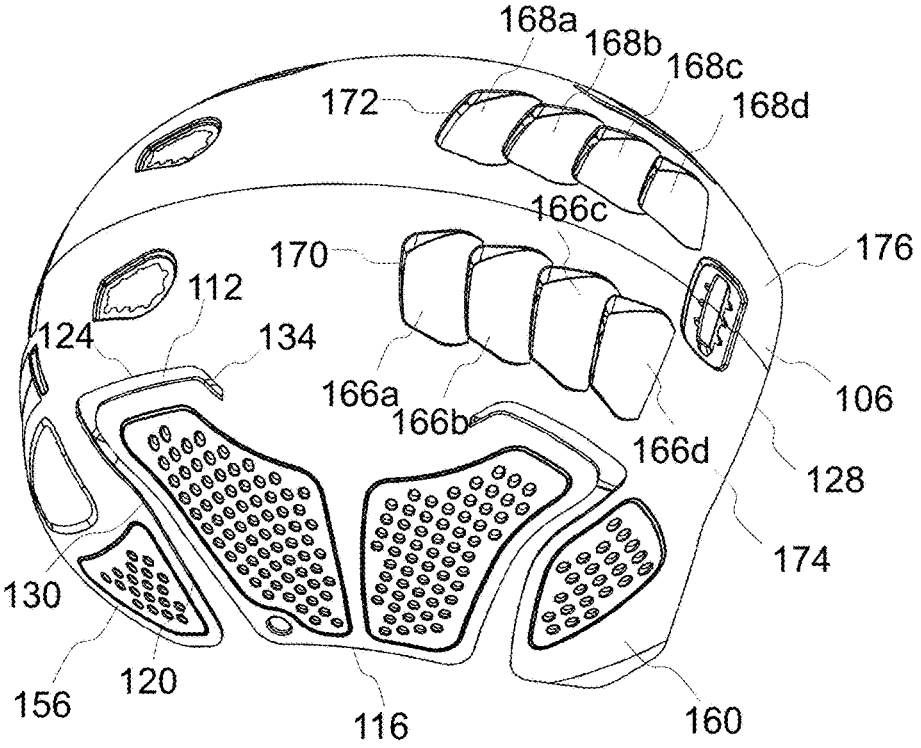
FIG. 2 illustrates a second view of the protective headgear.
Figure 3:
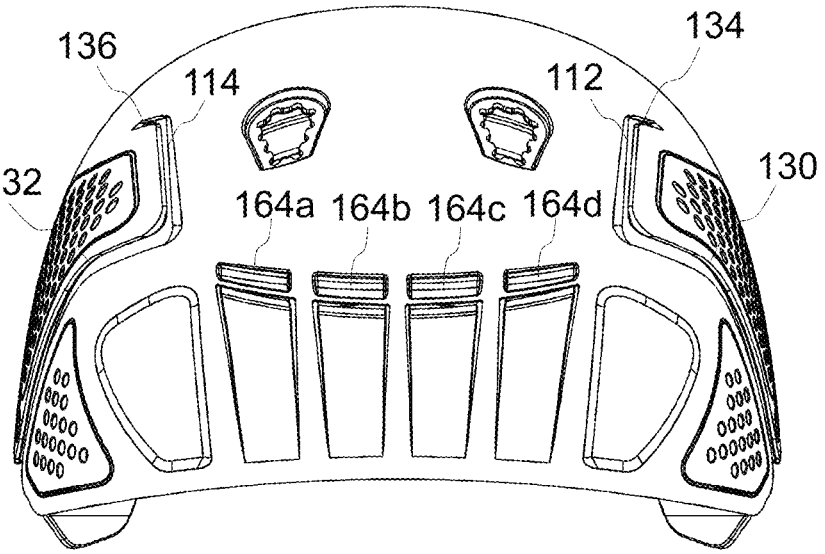
FIG. 3 illustrates a front view of the protective headgear.
Figure 4:
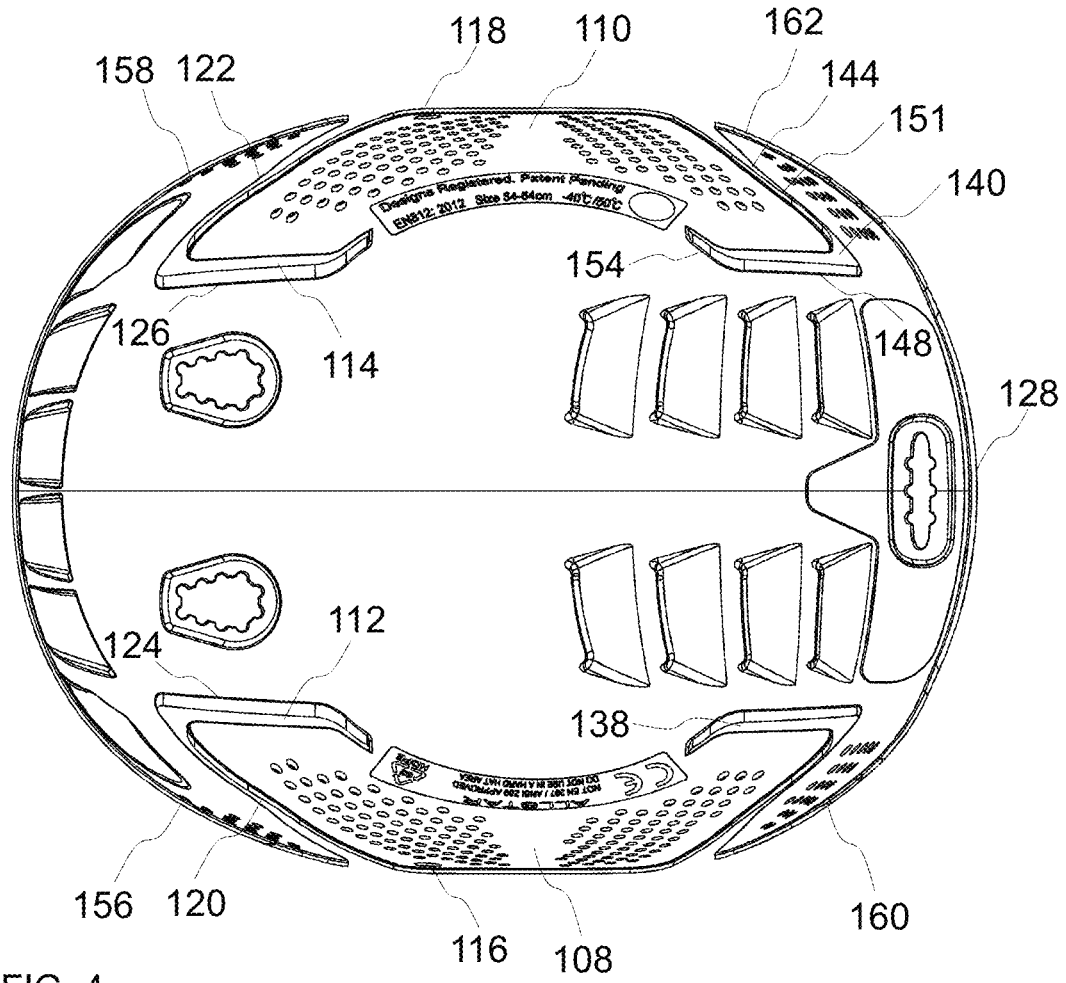
FIG. 4 illustrates a top view of the protective headgear.
Figure 5:
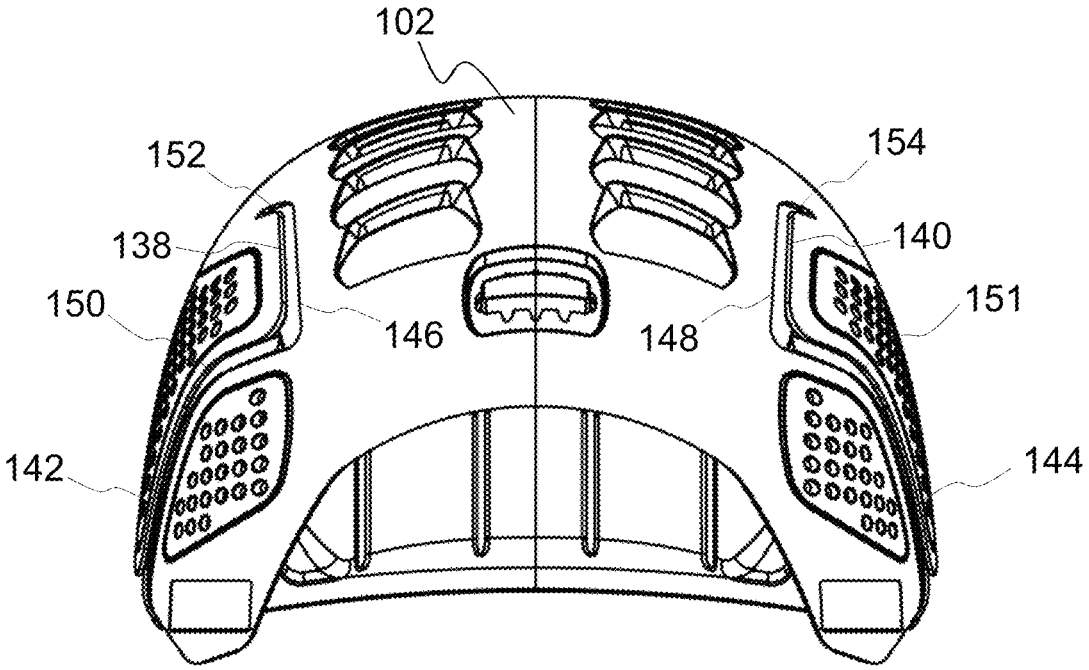
FIG. 5 illustrates a rear view of the protective headgear.
Figure 6:
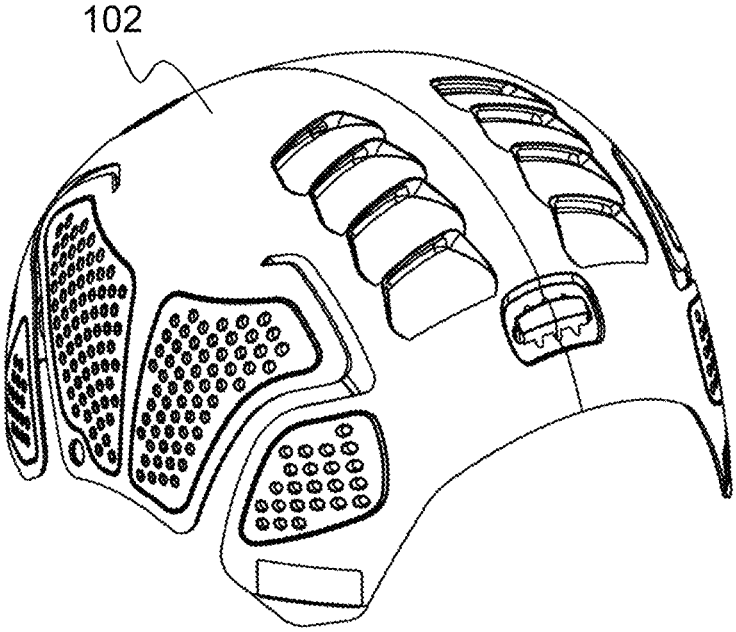
FIG. 6 illustrates a rear view at an angle of the protective headgear.
Figure 7:
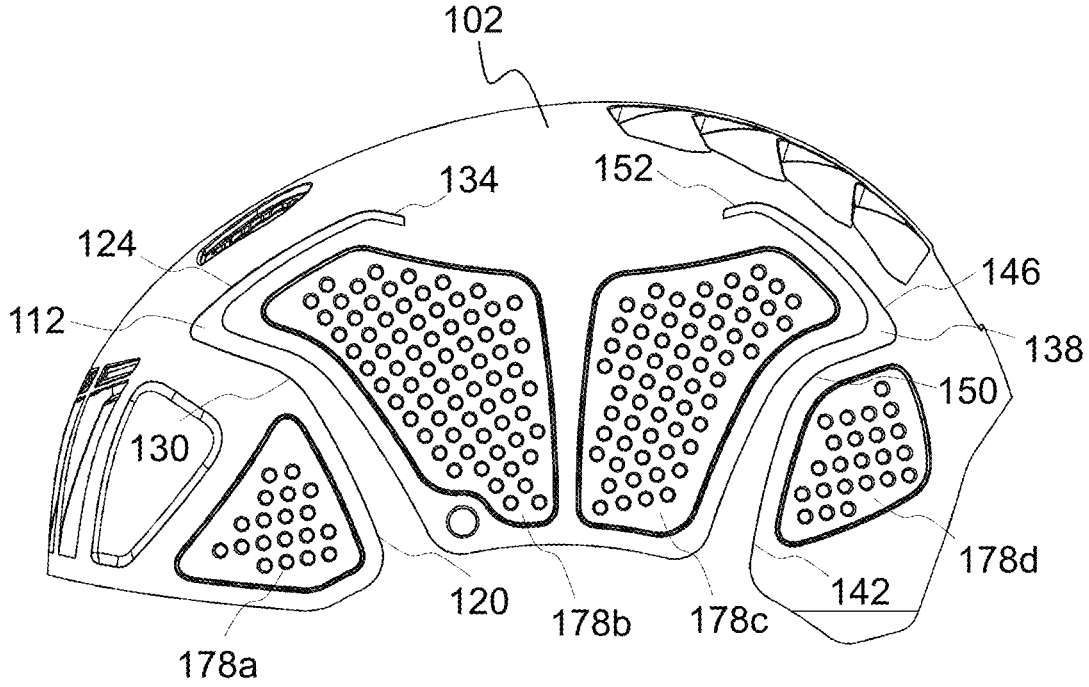
FIG. 7 illustrates a first side view of the protective headgear.

Referring to FIGS. 1-9, the protective headgear 100 comprises a protective shell 102. The protective shell 102 comprises a front section 104, a rear section 106 and a first and second side section 108, 110.

The front section 104 is formed by a first and a second front cut 112, 114 extending respectively from the first and second side edge 116, 118 of the protective shell 102. The first front cut 112 extends from the first side edge 116 of the protective shell 102 and the second front cut 114 extends respectively from the second side edge 118 of the protective shell 102.

The first and second front cut 112, 114 extends in a first direction 120, 122 towards the opposite side of the protective shell 102, and in a second direction 124, 126 towards the rear end 128 of the protective shell 102. The first direction 120, 122 may comprise one or more curved or angular forms 130, 132.

The first and second front cut 112, 114 extends in a third direction 134, 136 towards the rear end 128 so that the third direction 134, 136 diverges from the second direction 124, 126 towards the first and second side edge 116, 118 where the first and second front cut 112, 114 extends from. The third direction 134 of the first front cut 112 diverges towards the first side edge 116, and the third direction 136 of the second front cut 114 diverges towards the second side edge 118.

The first and second front cut 112, 114 may be arranged to the front half of the protective shell 102 when dividing the front and rear of the protective shell 102 with a center line.

The rear section 106 is formed by a first and a second rear cut 138, 140 extending respectively from the first and second side edge 116, 118 of the protective shell 102. The first rear cut 138 extends from the first side edge 116 of the protective shell 102 and the second rear cut 140 extends respectively from the second side edge 118 of the protective shell 102. The first and second rear cut 138, 140 extends in a first direction 142, 144 towards the opposite side of the protective shell 102, and in a second direction 146, 148 towards the front end 149 of the protective shell 102. The first direction 142, 144 may comprise one or more curved or angular forms 150, 151.

The first and second rear cut 138, 140 extends in a third direction 152, 154 towards the front end 149 so that the third direction 152, 154 diverges from the second direction 146, 148 towards the first and second side edge 116, 118 where the first and second rear cut 138, 140 extends from. The third direction 152 of the first rear cut 138 diverges towards the first side edge 116, and the third direction 154 of the second rear cut 140 diverges towards the second side edge 118.

The first and second rear cut 138, 140 may be arranged to the rear half of the protective shell 102 when dividing the front and rear of the protective shell 102 with a center line.

The front section 104 comprises a first and second front wing section 156, 158. The rear section 106 comprises a first and second rear wing 160, 162.

The first and second front cuts 112, 114 may be essentially symmetrical. The first and second rear cuts 138, 140 may be essentially symmetrical. The first and second front cuts 112, 114 may be essentially symmetrical with the first and second rear cuts 138, 140 so that the rear cuts are mirrored to the front cuts.

The first and second side section 108, 110 is formed by the front and rear cuts 112, 114, 138, 140. The first side section 108 is formed by the first front cut 112 and the first rear cut 138. Respectively, the second side section 110 is formed by the second front cut 114 and the second rear cut 140.

The protective shell 102 may comprise four inlets 164*a-d* arranged in the front section 104 of the protective shell 102 and eight outlets 166*a-d*, 168*a-d* arranged in the rear half of the protective shell 102. The outlets 166*a-d*, 168*a-d* may be formed as louvres, for example.

The inlets 164*a-d* may be arranged substantially at the same height in line so that they cover a significant portion of the width of the protective shell 102. Thus, air may enter in the front of the headgear across the width of the inlets 164*a-d*.

The outlets 166*a-d*, 168*a-d* may be arranged successively in a first and second line 170, 172 in the rear half of the protective shell 102. The first line 170 may comprise four outlets 166*a-d* arranged successively in line. The second line 172 may comprise four outlets 168*a-d* arranged successively in line.

The first and second line of outlets 170, 172 may be arranged respectively on a first and second side 174, 176 of the protective shell 102. The first and second lines of outlets 170, 172 may be arranged so that one outlet in each line is arranged substantially at the same height. The first and second lines of outlets 170, 172 may be arranged at a distance from each other.

Sections of ventilation holes 178*a-d* may be arranged to the first and second side 174, 176 of the protective shell 102. Four sections of ventilation holes 178*a-d* may be arranged on the first side 174 and four sections of ventilation holes 179*a*d may be arranged on the second side of the protective shell 102.

The protective shell 102 may be made of high-density polyethylene (HDPE) plastic, polycarbonate, polyamide (e.g. Nylon 6), polyoxymethylene (POM) or acrylonitrile butadiene styrene (ABS) for example.

Referring to FIGS. 10-22, the protective headgear 200 comprises a protective shell 102 and an insert 280.

The protective shell 102 may comprise attachment means such as two front attachment holes 182*a*, 182*b* and one rear attachment hole 182*c* for attaching the insert 280 to the protective shell 102.

Respectively, the insert 280 may comprise attachment means such as two front protrusions 284*a*, 284*b* and one rear protrusion 284*c* for attaching the insert 280 in the two front attachment holes 182*a*, 182*b* and one rear attachment hole 182*c* of the protective shell 102. The front and rear protrusions 284*a-c* may be fitted so that the protrusions attach with the front and rear attachment holes 182*a-c* of the protective shell 102. Thus, the insert 280 may be attached on the inside of the protective shell 102.

The insert 280 comprises four channels 286*a-d* to guide air from the inlets 164*a-d* of the protective shell 102 to the outlets 166*a-d*, 168*a-d* of the protective shell 102. The channels 286*a-d* may be arranged so that the channels align with the inlets 164*a-d* of the protective shell 102. Each channel 286*a-d* connects with one inlet 164*a-d*. Further, the channels 286*a-d* may be arranged so that two channels 286*a*, 286*b* connect with a first outlet 288*a* of the insert 280. Similarly, two further channels 286*c*, 286*d* may connect with a second outlet 290*a* of the insert 280.

The channels 286*a-d* form a passage between the insert 280 and the protective shell 102 for air flow. The channels 286*a-d* may be arranged as grooves in the insert 280.

The insert 280 comprises eight outlets 288*a-d*, 290*a-d*. The outlets 288*a-d*, 290*a*d of the insert 280 may be arranged so that the outlets of the insert align with the outlets 166*a-d*, 168*a-d* of the protective shell 102. The outlets 288*a-d*, 290*a-d* of the insert 280 may be arranged successively in a first and second line 292*a*, 292*b*. The first line 292*a* may comprise four outlets 288*a-d* arranged successively in line. The second line 292*b* may comprise four outlets 290*a-d* arranged successively in line.

Additionally, the channels 286*a-d* may comprise holes 294*a-h* to provide further ventilation in the protective headgear.

The insert 280 may be made of polypropylene foam, polystyrene foam or polyurethane foam, for example.

Figure 8:
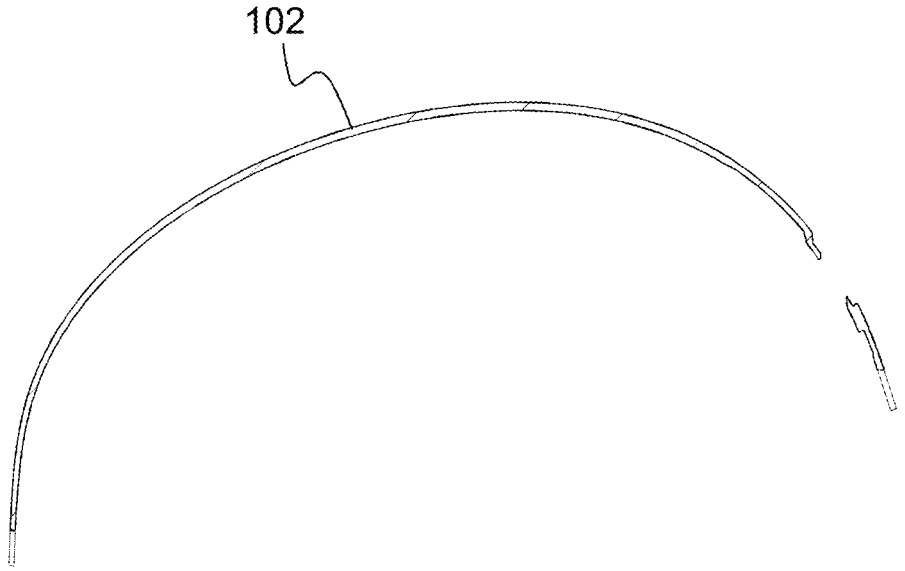
FIG. 8 illustrates a cross-section of the protective headgear.
Figure 9:
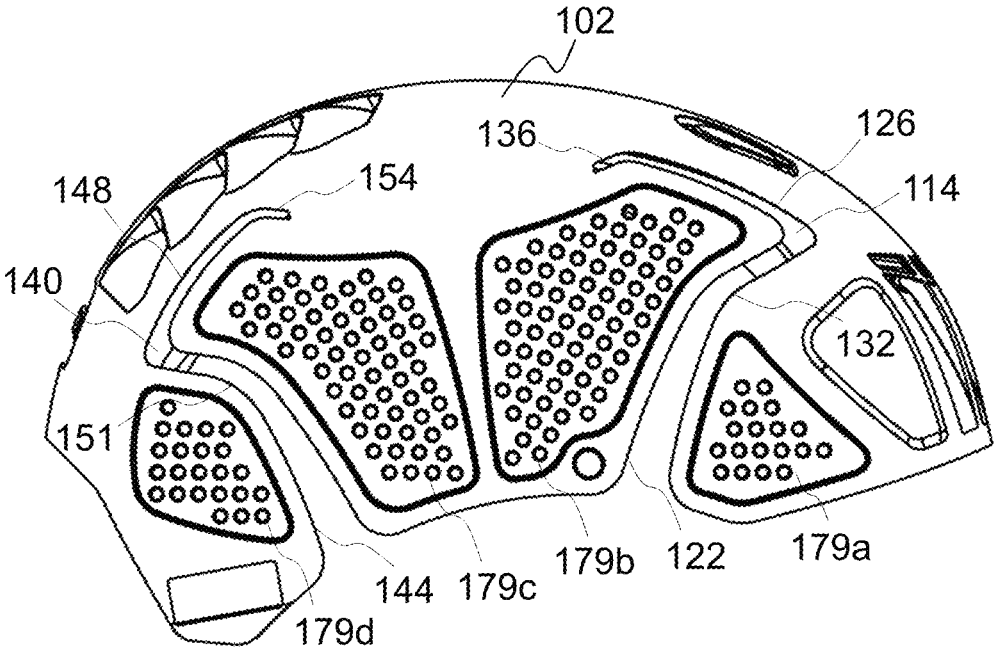
FIG. 9 illustrates a second side view of the protective headgear.
Figure 10:
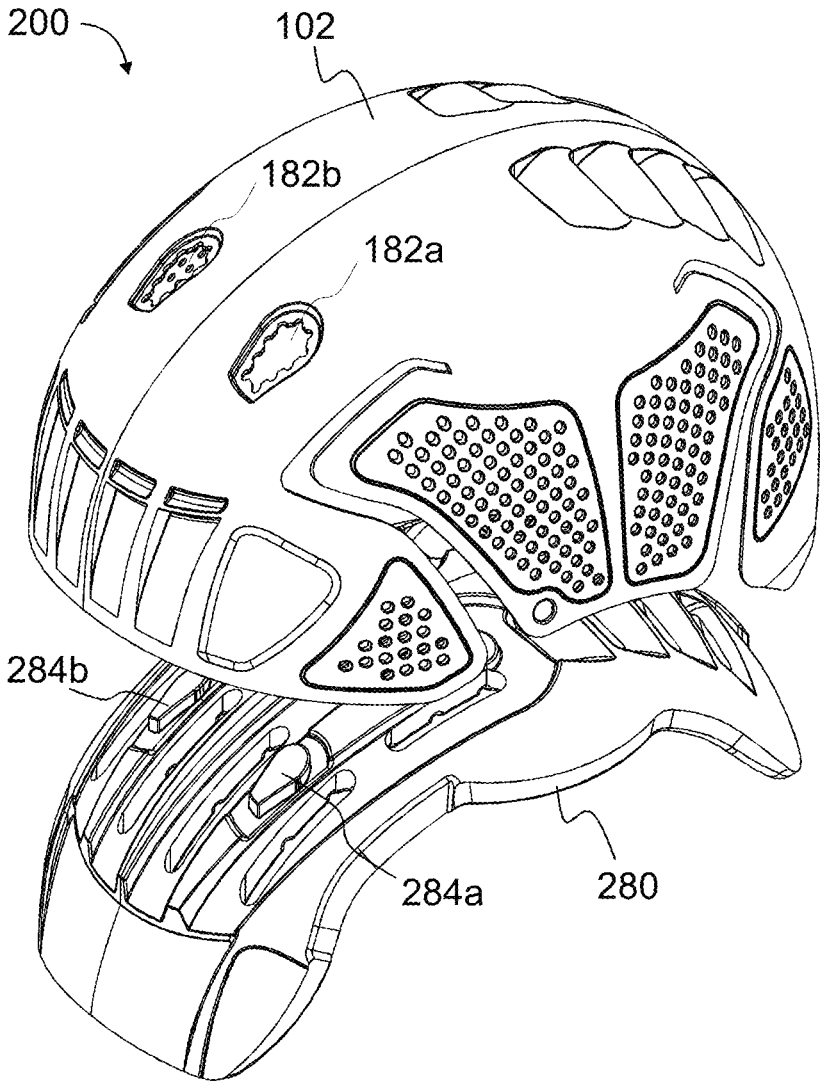
FIG. 10 illustrates a second embodiment of a protective headgear in accordance with the present invention.
Figure 11:
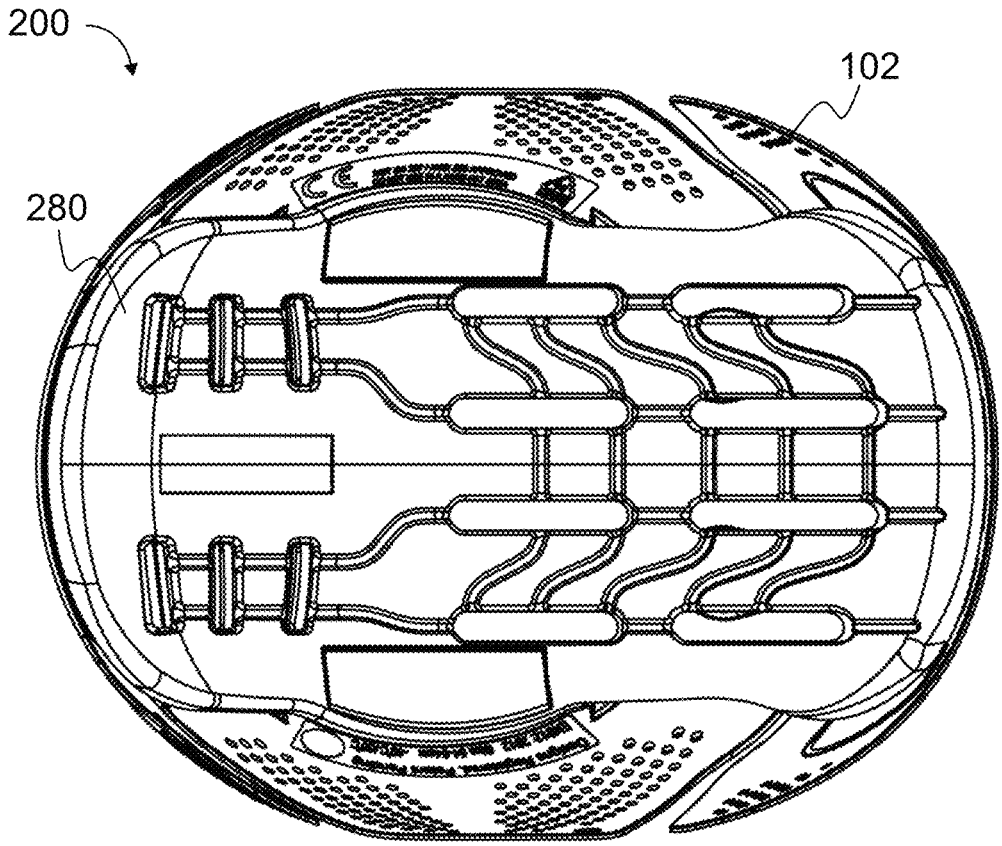
FIG. 11 illustrates a bottom view of the protective headgear.
Figure 12:
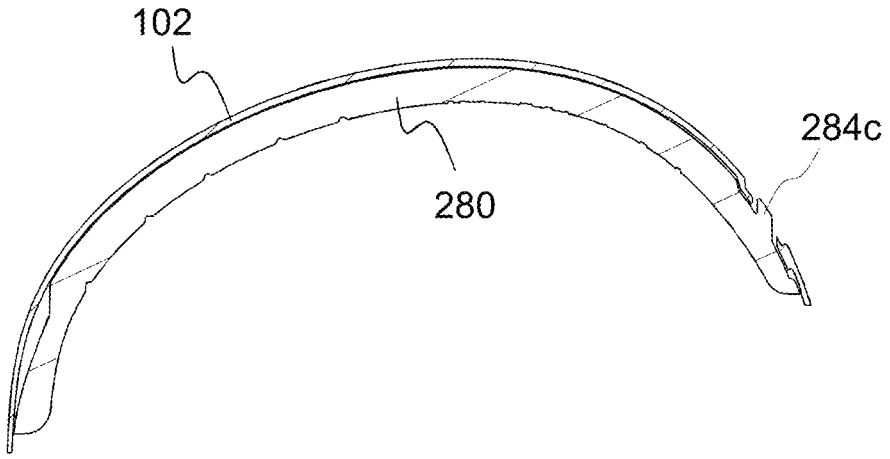
FIG. 12 illustrates a cross-section of the second embodiment of the protective headgear.
Figure 13:
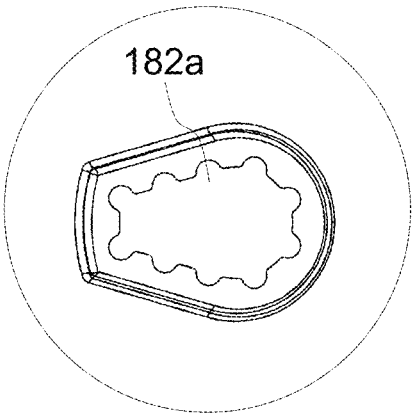
FIG. 13 illustrates a front attachment hole of a protective shell.
Figure 14:
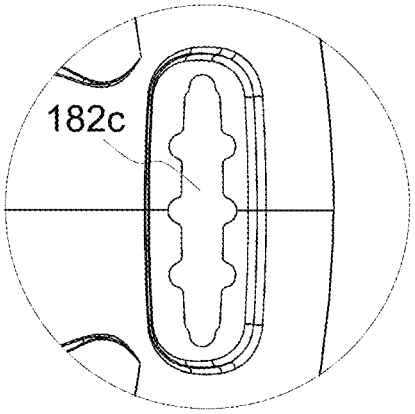
FIG. 14 illustrates a rear attachment hole of the protective shell.
Figure 15:
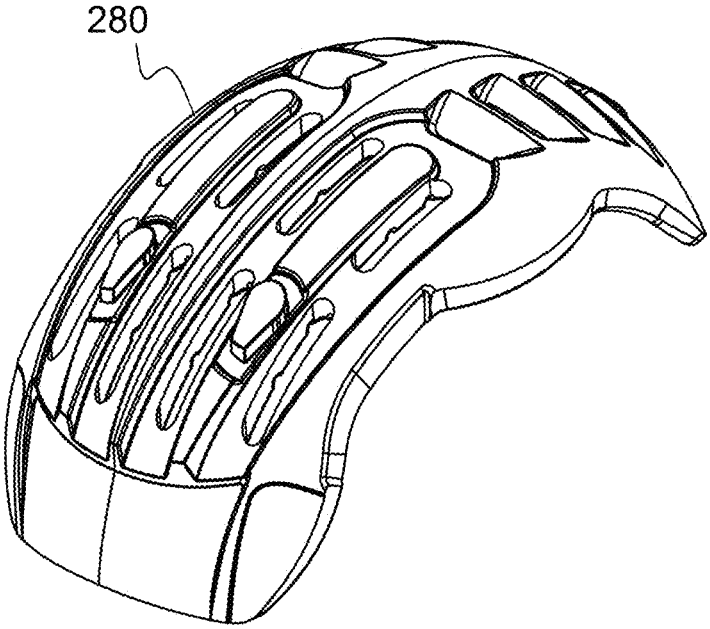
FIG. 15 illustrates an embodiment of an insert of the protective headgear.
Figure 16:
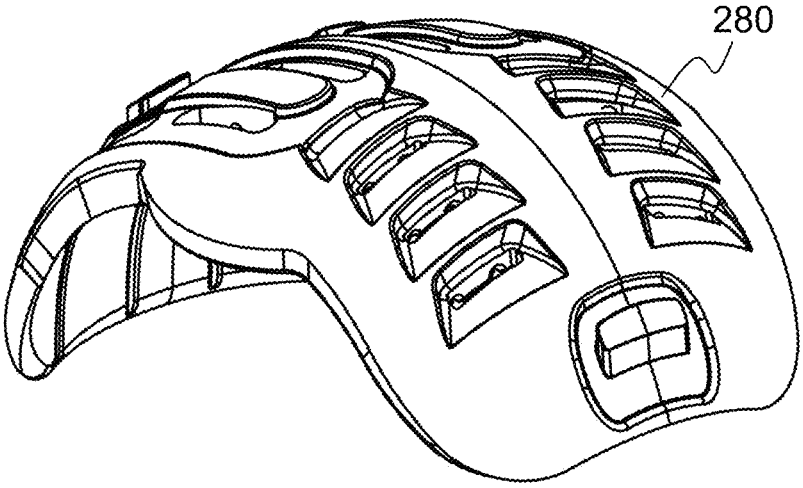
FIG. 16 illustrates a second view of the insert.
Figure 17:
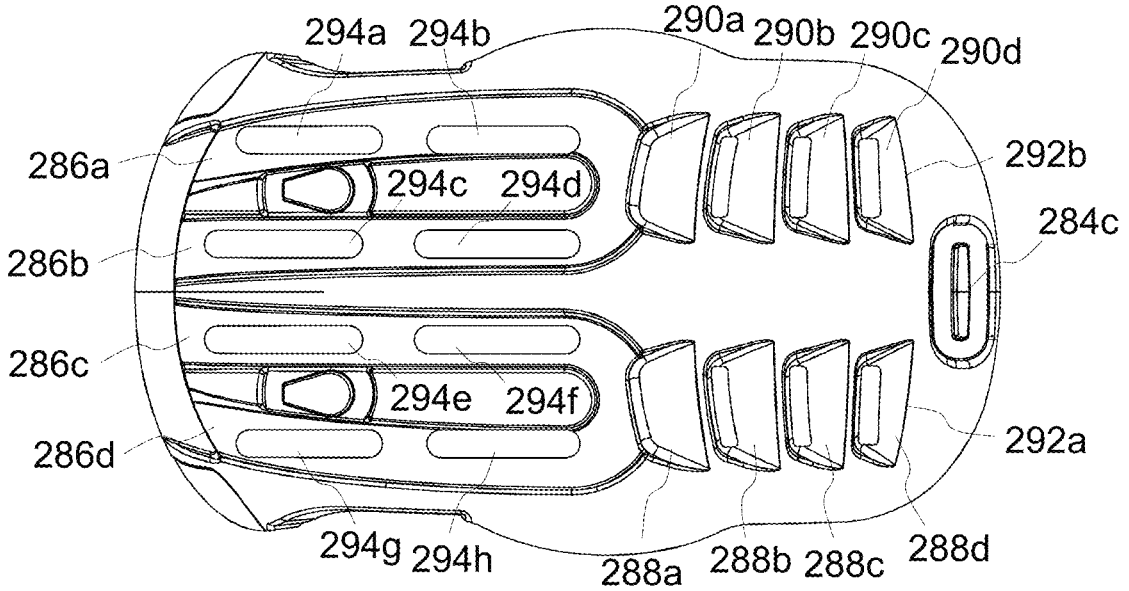
FIG. 17 illustrates a top view of the insert.
Figure 18:
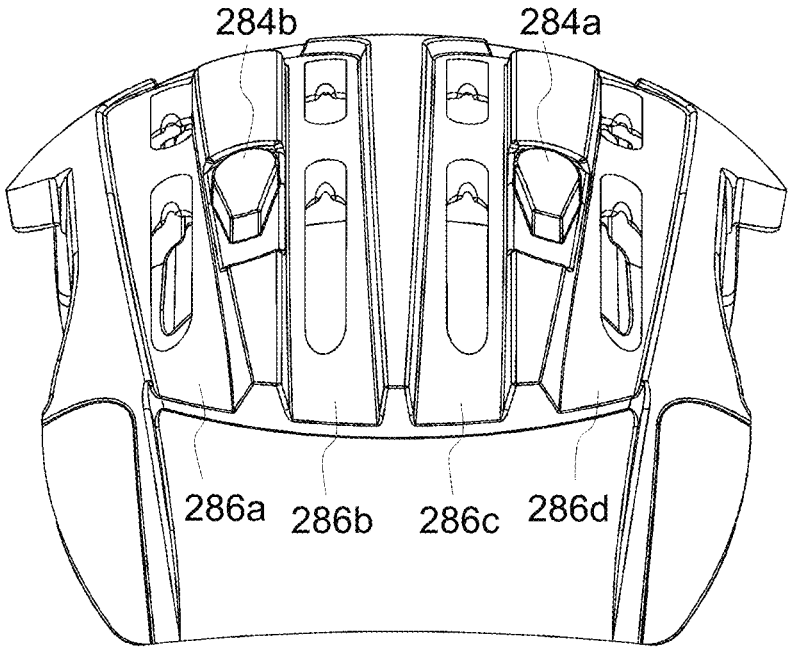
FIG. 18 illustrates a front view of the insert.
Figure 19:
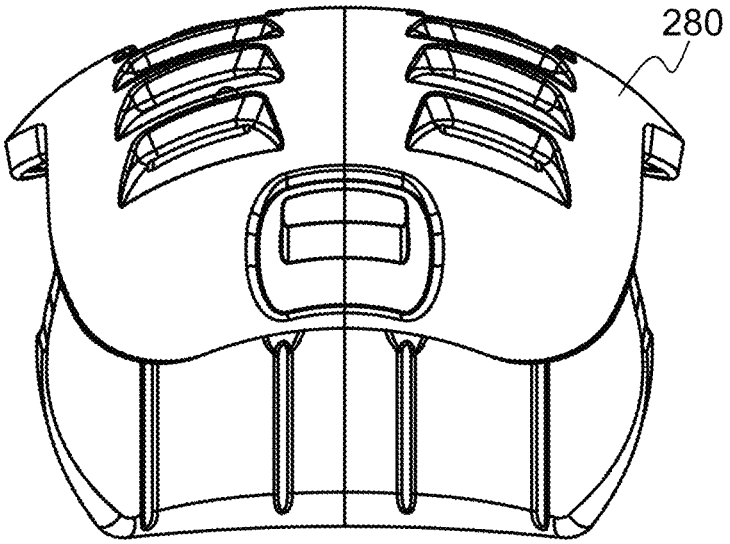
FIG. 19 illustrates a rear view of the insert.
Figure 20:
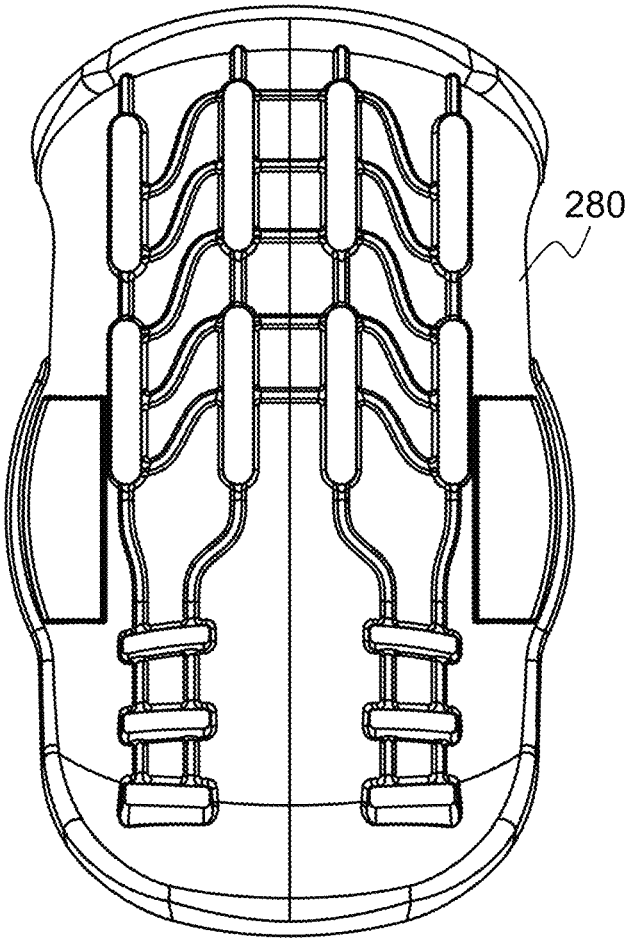
FIG. 20 illustrates a bottom view of the insert.
Figure 21:
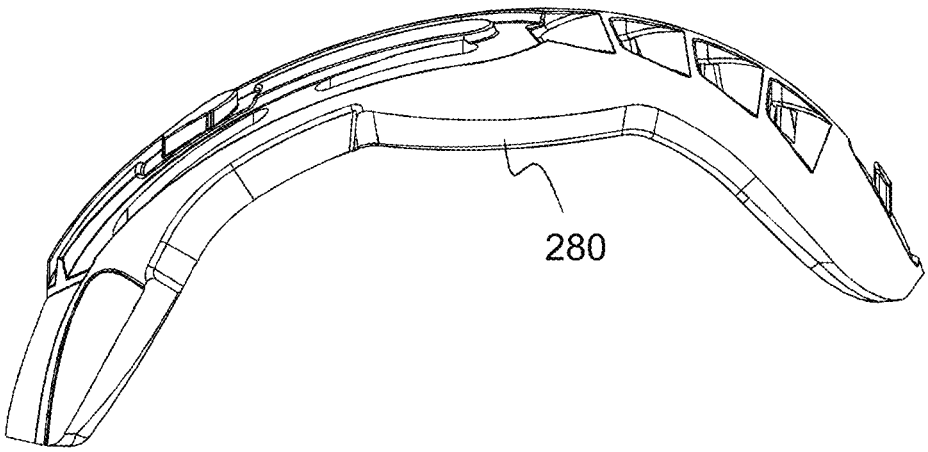
FIG. 21 illustrates a side view of the insert.

The protective shell 102 may have a height of approximately 119.5 mm, a width of approximately 168.8 mm, and a length of approximately 206.2 mm. Referring to FIG. 8, the protective shell 102 may have a thickness of approximately 2 mm. The thickness may vary in different parts of the protective shell 102. In some parts of the protective shell 102 the thickness may be 1.14 mm, 1.2 mm or 1.5 mm, for example.

Figure 22:
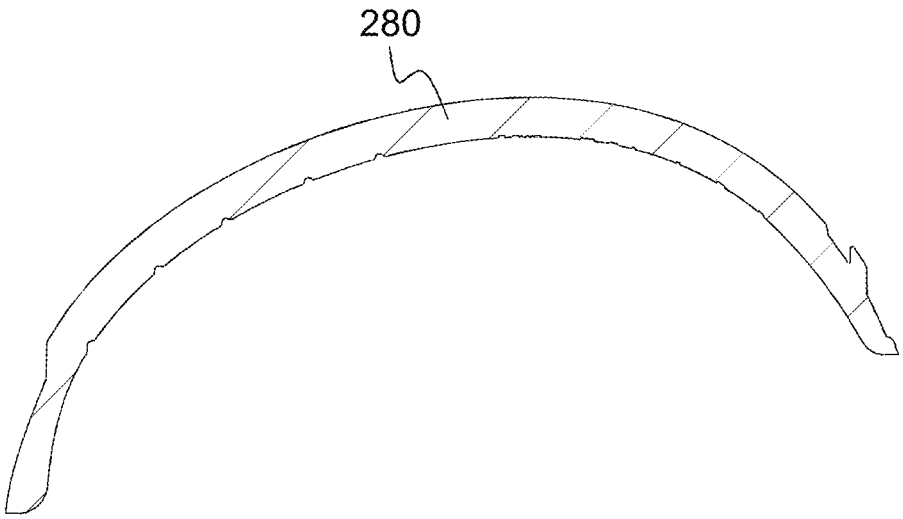
FIG. 22 illustrates a cross-section of the insert.

The insert 280 may have a height of approximately 99.1 mm, a width of approximately 126.6. mm, and a length of approximately 207.8 mm. Referring to FIG. 22, the insert 280 may have a thickness of approximately 9.2 mm. The thickness may vary in different parts of the insert 140.

Referring to figure, 12, the insert 280 and the protective shell 102 may form a thickness of approximately 11.5 mm when attached together. The thickness may vary in different parts of the protective headgear 200.

Consequently, a skilled person may on the basis of this disclosure and general knowledge apply the provided teachings in order to implement the scope of the present invention as defined by the appended claims in each particular use case with necessary modifications, deletions, and additions.

The invention claimed is:

1. A size adaptive protective headgear comprising:

a protective shell comprising a first front cut and a second front cut, each extending in a single, continuous line respectively from a first and second side edge of the protective shell, the first and second front cuts enabling expansion and contraction of a front section of the protective shell, wherein the first and second front cuts respectively i) initially extend from the first side edge of a first side section and the opposite, second side edge of a second side section of the protective shell in a first direction towards a centerline and toward the opposite side of the protective shell, ii) then extend further in a second direction towards a rear end of the shell, and iii) then still further extend in a third direction towards the rear end of the protective shell, the third direction diverging from the second direction towards the same respective first side edge of the first side section and the opposite, second side edge of the second side section where the first front cut and the second front cut initially extend from, and a first rear cut and a second rear cut extending respectively from a first and second side edge of the protective shell, the first and second rear cuts enabling expansion and contraction of a rear section of the protective shell, the first and second rear cuts extend in a first direction towards the opposite side of the protective shell, and in a second direction towards the front end of the protective shell, and the first and second rear cuts extend in a third direction towards the front end of the protective shell, the third direction diverging from the second direction towards the same first and second side edges where the first and second rear cuts extend from.

2. The size adaptive protective headgear of claim 1, further comprising an insert.

3. The size adaptive protective headgear of claim 2, further comprising attachment means for attaching the insert to the protective shell.

4. The size adaptive protective headgear of claim 3, wherein the attachment means comprises at least two front attachment holes and at least one rear attachment hole in the protective shell, and respectively at least two front attachment protrusions and at least one rear attachment protrusion in the insert, the at least two front attachment protrusions and at least one rear attachment protrusion being arranged to attach to the at least two front attachment holes and the at least one rear attachment hole.

5. The size adaptive protective headgear of claim 2, wherein the insert is made of polypropylene foam.

6. The size adaptive protective headgear of claim 1, wherein the protective shell is made of high-density polyethylene (HDPE) plastic.

7. The size adaptive protective headgear of claim 1, wherein the protective shell comprises at least one inlet in a front section of the protective shell and at least one outlet in a rear half of the protective shell for enabling air flow.

8. The size adaptive protective headgear of claim 7, further comprising an insert, wherein the insert comprises at least one channel arranged to guide air from the at least one inlet of the protective shell to the at least one outlet of the protective shell.

9. The size adaptive protective headgear of claim 7, further comprising an insert, wherein the protective shell comprises at least four inlets and at least eight outlets, the insert comprising at least four channels, wherein a first two of the channels converge to connect a first two of the inlets to a first one of the outlets and a second two of the channels converge to connect a second two of the inlets to a second one of the outlets.

10. A size adaptive protective headgear comprising:

a protective shell comprising a front section, a rear section, a first side section, and a second side section, wherein a centerline extends between the first side section and the second side section from the front section to the rear section, the protective shell further comprising a first front cut and a second front cut extending respectively from a first side edge of the first side section and an opposite, second side edge of the second side section of the protective shell, the first and second front cuts enabling expansion and contraction of the front section of the protective shell, and a first rear cut and a second rear cut extending respectively from the first side edge and the opposite, second side edge of the protective shell, the first and second rear cuts enabling expansion and contraction of a rear section of the protective shell, wherein the first and second front cuts respectively i) initially extend from the first side edge of the first side section and the opposite, second side edge of the second side section of the protective shell in a first direction towards the centerline and toward the opposite side of the protective shell, ii) then extend further in a second direction towards a rear end of the shell, and iii) then still further extend in a third direction towards the rear end of the protective shell, the third direction diverging from the second direction towards the same respective first side edge of the first side section and the opposite, second side edge of the second section where the first front cut and the second front cut initially extend from, and wherein the first and second rear cuts respectively i) initially extend from the first side edge of the first side section and the opposite, second side edge of the second side section of the protective shell in a rearward first direction towards the centerline and toward the opposite side of the protective shell, ii) then extend further in a forward second direction towards a front end of the shell, and iii) then still further extend in a forward third direction towards the front end of the protective shell, the forward third direction diverging from the forward second direction towards the same respective first side edge of the first side section and the opposite, second side edge of the second section where the first rear cut and the second rear cut initially extend from.

11. The size adaptive protective headgear of claim 10, wherein, the first and second front cuts are symmetrical with each other, the first and second rear cuts are symmetrical with each other, and the first and second front cuts are respectively symmetrical with the first and second rear cuts with the first and second rear cuts mirroring the first and second front cuts.

* * * * *